United States Patent [19]

Nagano

[11] 4,455,783

[45] Jun. 26, 1984

[54] TOY LOCOMOTIVE

[75] Inventor: Toshiaki Nagano, Omocha-no, Japan

[73] Assignee: Shinsei Kogyo Co., Ltd., Tokyo, Japan

[21] Appl. No.: 386,391

[22] Filed: Jun. 8, 1982

[30] Foreign Application Priority Data

Jun. 15, 1981 [JP] Japan ..... 56-87658[U]

[51] Int. Cl.[3] ..... A63H 11/10

[52] U.S. Cl. ..... 446/71; 446/446

[58] Field of Search ..... 46/202, 257, 251, 201, 46/217, 216, 206, 113

[56] References Cited

U.S. PATENT DOCUMENTS

| | | | |
|---|---|---|---|
| 2,897,770 | 8/1959 | Bonanno | 46/217 X |
| 3,517,458 | 6/1970 | Sato | 46/251 |
| 4,304,066 | 12/1981 | Brand et al. | 46/257 X |
| 4,365,438 | 12/1982 | Nelson | 46/202 |

FOREIGN PATENT DOCUMENTS

| | | | |
|---|---|---|---|
| 836913 | 4/1952 | Fed. Rep. of Germany | 46/206 |

*Primary Examiner*—Mickey Yu

*Attorney, Agent, or Firm*—Kenyon & Kenyon

[57] ABSTRACT

A toy locomotive includes a locomotive body and a planar track member. The locomotive body comprises a clockwork driving mechanism with a knurled knob, a small bogie and a pinion mounted to an outshaft of the driving mechanism, a crown gear meshing with the pinion, a drive and an auxiliary wheels suspended on the bogie and one or more guide pin also extended from the bogie. The planar track member comprises an endless groove for engaging with the guide pin. The track member may be one of a number of planar track members, such as pages connected together in the manner of a book.

7 Claims, 7 Drawing Figures

TOY LOCOMOTIVE

BACKGROUND OF THE INVENTION

1. Field of the Invention

This invention relates to a toy locomotive, especially a toy locomotive propelling itself by means of a clockwork drive mechanism along a curved track having a groove in a substantially planar surface. The term "toy locomotive" as used herein refers to a self-propelled toy vehicle which may be in the form of a train, or a car or even an animal or any other form.

2. Prior Art

There has hitherto been known a toy in which a locomobile, such as a train, a tram, a car or the like, is moved by a clockwork drive mechanism along a groove in the form of curved lines combined with straight lines, which is provided in a planar track member of a paper material or others. However, such a type of the conventional toy has several disadvantages in that the free steering and the stable running are difficult to be obtained because the toy body is provided with a drive wheel driven by a clockwork mechanism while a guide pin is independently fixed directly to the toy body at its lower front fact, which pin is engaged into the groove to guide the running of the locomotive, in that the guide pin is disturbed by a groove wall at an acute curvature or a crossed section of the groove, leading to frequent troubles of stoppage or tumbling, and in that on the same reason the track construction is limited and acute curves of the track may not be constructed, resulting in an uninteresting toy.

Further, there has hitherto been unknown an amusing and educational toy in which the locomobile runs along the track in the form of grooves provided on pages of a book, such as a picture book for children, such that the child may be induced by his interest in the locomobile to learn the names of the objects on the pages.

Accordingly, this invention provides a toy locomotive which eliminates the disadvantages as described hereinbefore and allows the free and stable running without stoppage or tumbling at the acute curves or crossed sections, notwithstanding the rather simple construction, and which accomplishes an amusing and educational purposes not only for the children but also the adult.

The principal features of the invention reside in that the drive wheel may be turned integrally with the guide pin, and in that an auxiliary wheel is arranged oppositely to the drive wheel and is freely rotated upon running for absorbing the differential resistance.

SUMMARY OF THE INVENTION

Accordingly, a principal object of the invention is to provide a toy locomotive running along an endless track, which comprises a locomotive body and a planar track member, said locomotive body comprising a clockwork driving mechanism with a knurled knob for winding up the driving mechanism, a small bogie and a pinion mounted to an output shaft of the driving mechanism, a crown gear meshing with the pinion, a drive wheel integral with the crown gear, a freely rotatable auxiliary wheel arranged oppositely to the drive wheel, said both wheels being suspended on the small bogie, and one or more guide pin extended downwardly from the bogie in a longer length than the diameter of the wheels, and said planar track member comprising an endless groove for forming the endless track and engaging with the guide pin.

PREFERRED EMBODIMENTS OF THE INVENTION

In the toy locomotive according to the invention, the planar track member is consisted of pages of a book, such as a picture book for children.

Further, the drive wheel of the toy locomotive is preferably made of or covered at its periphery with a material of high frictional characteristics.

Furthermore, in the toy locomotive of the invention, the guide pin is perpendicular to an axis of the drive and the auxiliary wheels.

The construction of the present invention is particularly simple and permits reliable toy locomotive to be cheaply manufactured and extremely small, weighing as little as 10 to 50 grams which is preferably clockwork driven. The provision of the guide member which may be in the form of a pin in front of the drive wheel which turns the drive wheel ensures that the tractive force is always exerted in precisely the direction that the track actually extends so that there is a high efficiency of tractive effort and little tendency for the locomotive to leave the track. It is also particularly easy for a young child to engage the locomotive with the track by sliding it transverse to the groove until the guide pin drops into the groove. At this point the drive wheel is unlikely to be pointing in precisely the right direction but the pivoting bogie automatically corrects this as soon as the locomotive starts to move. The locomotive is preferably provided with two free-wheeling rear wheels but these merely enhance the locomotive's stability and its ability to travel freely.

The locomotive may be used on any suitable track member affording a groove which is both wide and deep enough to accommodate the guide pin whilst the drive wheel engages the surface of the track member adjacent the groove. It does however find particular application in combination with what is referred to as a track book to constitute a child's toy which is both entertaining and instructive. The invention thus also embraces the combination of such a locomotive with a track book comprising at least two planar track members hinged together in the manner of pages, each affording a groove for the reception of the guide pin. The use of such a track book permits two or more different tracks to be provided in a simple manner thus retaining the child's interest for longer than would be the case with a single track and each track may be associated with different graphic material and colour schemes. The book may have any number of pages, typically between 2 and 10, and each surface of each page may constitute a track or only selected surfaces.

In the preferred construction one page of each pair that may be viewed simultaneously carries pictures and associated wording and the other carries the same pictures distributed along a continous groove for the reception of the guide pin. Such a construction is not only entertaining to a young child but also educational in that if used with an adult the pictures on the one page can be studied and the names of the objects learnt with the aid of the associated wording and these names can then be repeated and thus learnt as the locomotive goes round the track on the other page of the pair currently visible and passes the various objects in turn.

Further features and details of the invention will be apparent from the following description of one specific embodiment which is given by way of example only with reference to the accompanying diagrammatic drawings.

BRIEF EXPLANATION OF THE DRAWINGS

In FIGS. 1 and 2, numerical references 10, 12 and 14 represent a track member, an endless groove formed in the track member and a locomotive running along the groove, respectively. The track member 10 may be formed by putting two cardboards a, b (as shown in FIG. 4) and providing a groove 12 into the upper cardboard a but is not limited thereto.

Figure 1:
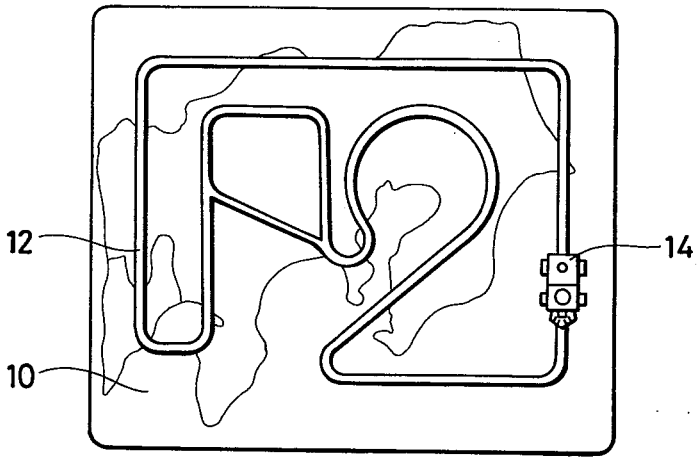
FIG. 1 is a plan view of one embodiment of the toy locomotive according to the invention.
Figure 2:
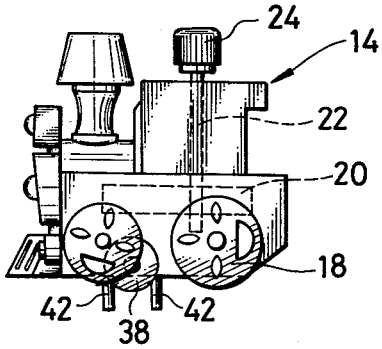
FIG. 2 is a side view of a locomotive used in the toy locomotive of the invention.

The running toy 14 may be of any shape, such as a train, a car or an animal, especially a locomotive as shown in FIG. 2. A structure of the locomotive is shown in detail in FIGS. 3 to 5. The locomotive 14 has a body 16 containing a cavity 50 therein. At either sides of the body 16 are arranged at least a pair of free wheels 18, 18. In addition, the cavity 50 contains a clockwork (or a spring) drive mechanism 20 accommodated in a casing 60. An input shaft 22, to which is fixed the clockwork 62 at its one end, is extended out of the body 16, an extruded end of which shaft is provided with a knurled knob 24 for winding up the spring 62.

Figure 4:
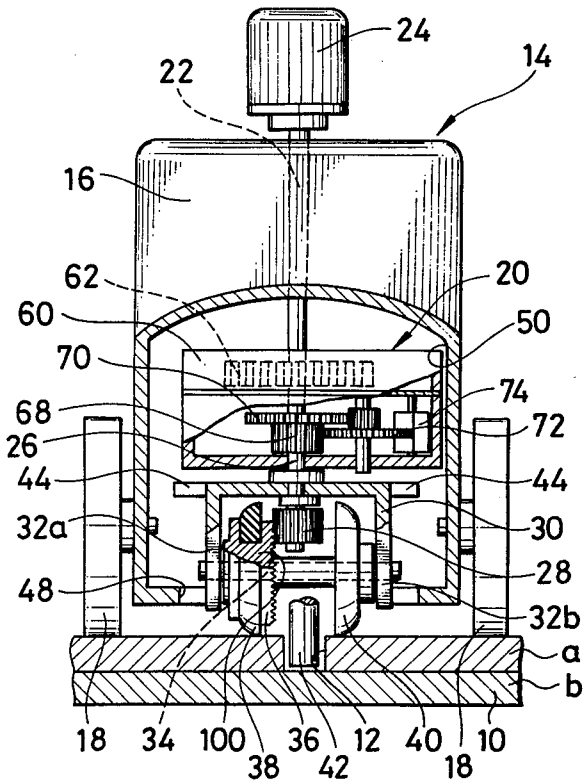
FIG. 4 is a longitudinally sectional front view of the locomotive in FIG. 3 also showing a driving and gearing mechanism.
Figure 3:
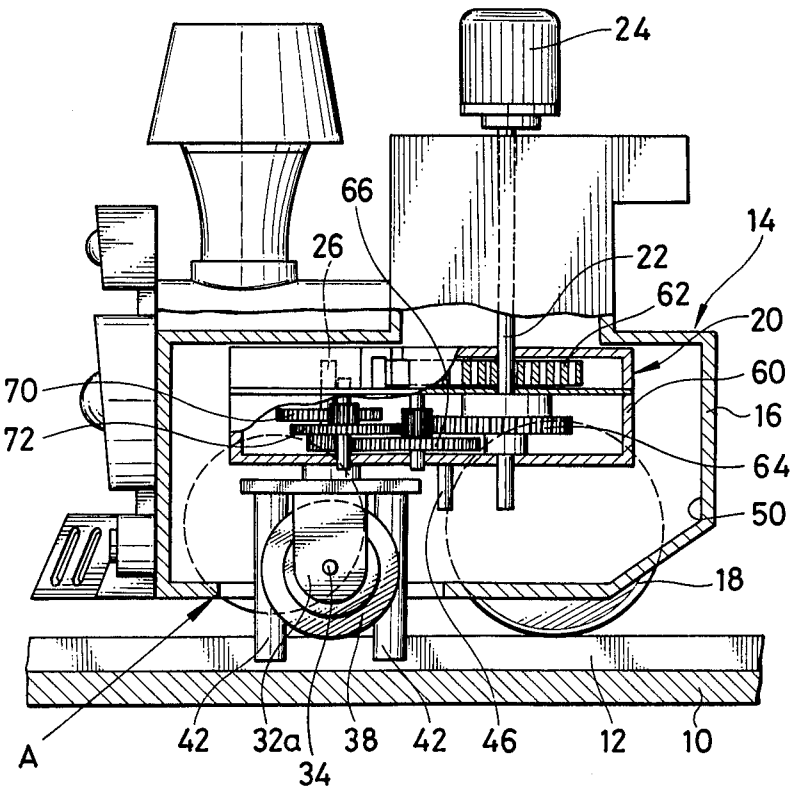
FIG. 3 is a partially broken side view of the locomotive showing a gearing and driving mechanism.

A structure of the clockwork drive mechanism 20 is of any type, but in one embodiment as shown in FIGS. 3 and 4 a first gear 64 is mounted to the input shaft 22 below the spring 62. Adjacent to the first gear 64 is arranged a second gear 66 which has a pinion meshing with the first gear 64. Near the second gear 66 is fitted an output shaft 26 extending downwardly out of the casing 60. Within the casing 60 at the outer periphery of the output shaft 26 is provided a third gear 70 which has a pinion gear 68 meshing with the second gear 66. Adjacent to the third gear 70 is arranged a fourth gear 72 having a pinion, with which fourth gear is engaged a detent block 74 of groove type.

Figure 5:
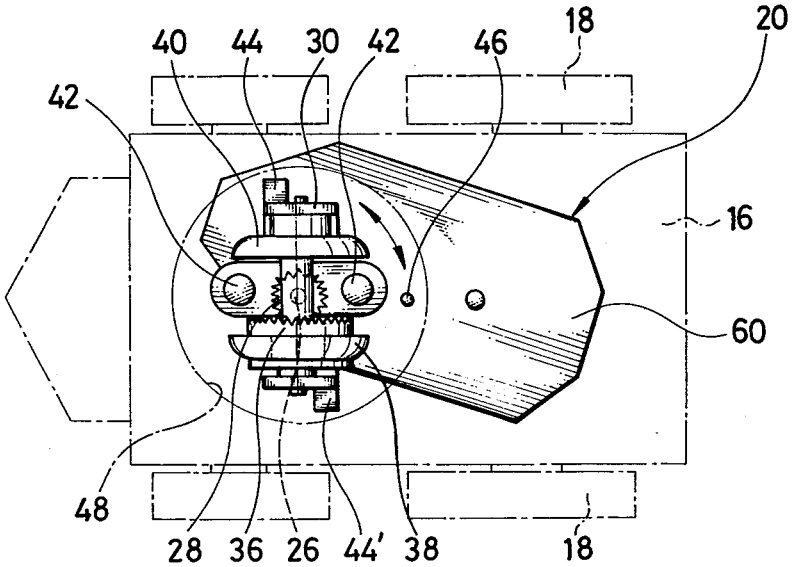
FIGS. 5 and 6 are bottom views showing respective embodiments of the toy body in an imaginative line.

A symbol A in FIG. 3 shows the running mechanism employed in accordance with the present invention. As illustrated in FIGS. 3 to 5, the output shaft 26 extending out of the casing is provided at its front end with a pinion 28, above which is arranged a small bogie 30 having a front view of a groove shape. Between arms 32*a* and 32*b* of the bogie 30 is bridged a wheel shaft 34, onto which is fitted a drive wheel 38 integral with a crown gear 36 meshing with the pinion 28, as well as an auxiliary wheel 40 which is arranged oppositely to the drive wheel 38 and is freely rotatable.

The drive wheel 38 is of approximately equal diameter to the auxiliary wheel 40 but is made of or covered with a material of high frictional characteristics, while the auxiliary wheel 40 is made of plastics, for example. A method of integrating the drive wheel 38 with the crown gear 36 is optionally chosen but in the embodiment of FIG. 5 a flange 100 with a groove may be juxtaposed to the crown gear 36, onto which is fitted the drive wheel 38.

Further, two pins 42, 42 are extruded from the small bogie 30 at the middle point between the drive and the auxiliary wheels 38, 40 and perpendicularly to the wheel shaft 34 as shown in FIG. 5. These pins 42, 42 are extended longer than the diameter of the drive and the auxiliary wheels 38, 40.

Figure 6:
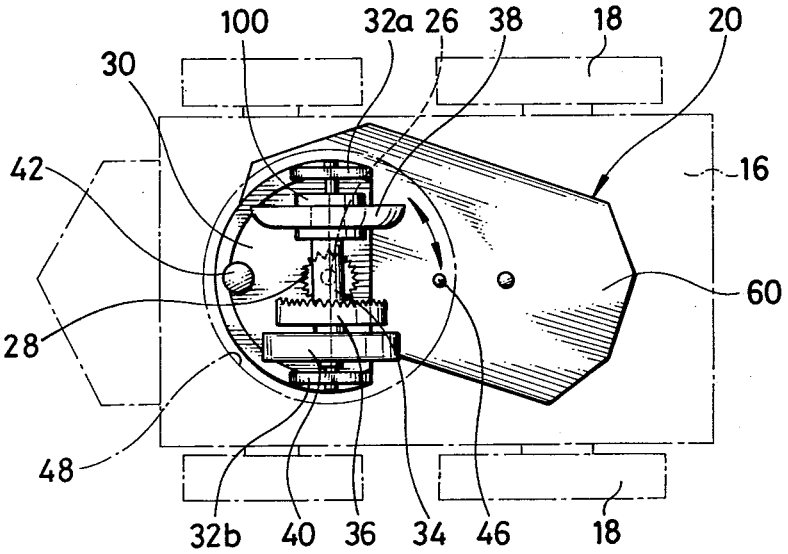

Alternatively, the toy locomotive 14 according to the invention may be modified for its drive and auxiliary wheels 38, 40 as shown in FIG. 6, using a single guide pin 42 which is fitted into the groove 12 of the track. For the convenience of illustration the same numerical references are used for the same components as in FIGS. 3 to 5. Namely, the small bogie 30 is shaped in the form of a half disc, from which at its middle part of the curved edge is protruded a single pin 42, while at its both ends are oppositely arranged arms 32*a*, 32*b*. Between the arms 32*a* and 32*b* is pivoted a wheel shaft 34, at the middle position of which is provided an output shaft 26 inserted into the small bogie 30 which is turnably supported relative to the shaft 26. The output shaft 26 is provided at its one end with a pinion 28, which is meshed with a crown gear 36 provided at one end of the wheel shaft 34 for driving the latter. In this case of FIG. 6, an auxiliary wheel is free-rotatably mounted onto one end of the wheel shaft 34 having the crown gear 36, while on its other end is provided a flange 100 with a groove, onto which is fitted a drive wheel 38 of a ring shape, as in the previous embodiment. Other construction is similar to that of FIG. 5. Thus, in accordance with this embodiment, the crown gear 36 and the drive wheel 38 may be spaced apart from the pinion 28 and oppositely arranged thereto, thereby causing an advantage of ensuring the running stability even only with the single guide pin 42.

According to the embodiments of FIGS. 5 and 6, the small bogie 30 is arranged so as to freely turn around the output shaft 26 in the clockwise or anticlockwise direction. In these embodiments, in order to prevent turning beyond a given range, the bogie 30 is provided with protruded pieces 44, 44' while the casing 60 is provided at its bottom surface with a stopper 46 capable of engaging with the protruded pieces 44, 44', thereby permitting the small bogie 30 to turn in the given range (for example, about 90° as shown in FIG. 5). Further, the body 16 is provided at its bottom with an aperture 20.

In accordance with the toy locomotive thus constructed, the insertion of the pin 42 into the groove 12 of the track member 10 and the contract of the drive and the auxiliary wheels 38 and 40 as well as the free wheels 18, 18 with the track member 10 may allow the locomotive 14 to be supported on three points, and the drive and the auxiliary wheels 38, 40 to be constantly contacted with the track surface through the weight of the locomotive 14.

Then, winding up of the knurled knob 24 may accumulate the driving force in the clockwork mechanism 20 and discontinuation of the winding up may release the accumulated driving force gradually to the output shaft 26, thereby rotating the pinion 28 at the top end of the output shaft 26, which transmits the rotation force to the crown gear 36 and hence to the drive wheel 38 integral with the crown gear 36. Thus, the forward rotation of the drive wheel 38 carries the locomotive 14 forwardly. The pin 42, which is extended from the bogie 30 and located immediately adjacent to the drive wheel 38, is fitted into the groove 12 for guiding the locomotive 14.

The pin 42 is mounted together with the drive and the auxiliary wheels 38, 40 to the small bogie 30 which is turnable around the output shaft 26, thereby allowing the pin 42 to be followed smoothly in the curved groove of an acute angle or small radius curvature and the wheels 38, 40 to be correctly directed toward the advancing direction. If the plurality of pins (such as two pins 42, 42) are used which are arranged in front of and at the rear of the bogie 30 in the wider distance than the groove width, the locomotive 14 may run smoothly and steadily along the groove 12 which may be crossed.

In accordance with the invention the free rotation of the auxiliary wheel 40 relative to the wheel shaft 34 assures the more smooth running through its resistance-absorbing action than the conventional toy in which the resistance due to difference of the rotation numbers between the drive and the auxiliary wheels 38 and 40 upon running at the curved portion could cause deviation and tumbling of the locomotive.

Figure 7:
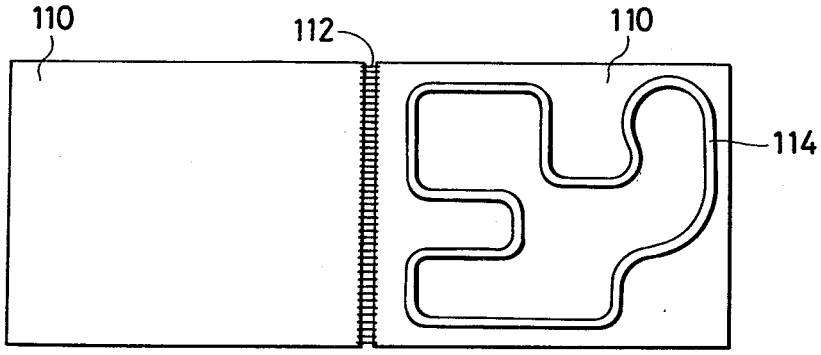
FIG. 7 is a plan view of a track book from which all words and pictures have been omitted for the sake of simplicity.

The locomotive according to the invention may be used on any kind of track member with an elongate groove or recess but the preferred form of the track is illustrated in FIG. 7. This comprises what will be termed a track book comprising three or more rectangular book pages 110 hinged together along one side by a plurality of wire loops 112. Each page, with the exception of the front cover page, is constituted by two sheets of cardboard glued back to back and the upper sheet of each right hand page is provided with an endless slot 114 which constitutes a groove in the page for the reception of the guide pin of a locomotive. Each left hand page bears pictures of well known objects such as animals, building, flowers or the like together with a brief associated description. The same pictures appear on the associated right hand page distributed along the slot 114 without the description.

When a child wishes to play with the track book and locomotive he first studies the pictures and description on a left hand page, probably with the aid of an adult. The locomotive is then places on the track member constituted by the associated right hand page with it guide pin received in the slot. The locomotive then passes around the track and as it does so the child may be encouraged to recite the previously learnt names of the objects passed or alternatively the name of the object nearest to which the locomotive stops. The toy is found to be entertaining to a child and simultaneously educational in that the child is induced by his interest in the locomotive to learn the names of the objects on the pages. When the names on one set of pages have been learnt or the child has lost interest in the objects on one set of pages, the page may be turned thus revealing a new set of objects and a different track.

In accordance with the invention as described hereinabove, the toy locomotive may be obtained which permitts the very stable transmission of the drive force and the guidance for running, as well as the smooth running without troubles of stoppage or tumbling at the acutely curved or crossed portion, resulting in a very amusing toy locomotive. Further, as described previously, the toy locomotive may be placed on the track member constituted by the pages of a book which describe the names of the objects or illustrate the pictures, thus resulting in not only an entertaining but also educational toy.

What is claimed is:

1. A toy locomotive constructed to run along a track defined by a groove in a track surface, which comprises a locomotive body, at least two wheels laterally spaced apart mounted to the body to rotate freely, a clock work driving mechanism disposed in the body having a knurled knob for winding the driving mechanism, a small bogie suspended from the body, a drive wheel suspended from the bogie, a freely rotatable auxiliary wheel disposed opposite to and spaced from the drive wheel suspended from the bogie, the drive mechanism having an output shaft, a pinion mounted to said output shaft, a crown gear meshing with the pinion, the drive wheel being connected with the crown gear, and one or more guide pins connected to and extended downward from the bogie between the drive and auxiliary wheels beyond the bottom of the drive and auxiliary wheels in order to engage the groove in the track surface.

2. The toy locomotive according to claim 1, wherein the track comprises an endless groove formed in the page of a book, such as a picture book for children, for engaging said guide pin.

3. The toy locomotive according to claim 1, wherein the drive wheel includes a peripheral portion having a high coefficient of friction.

4. The toy locomotive according to claim 1, wherein the drive wheel is made of a material having a high coefficient of friction.

5. The toy locomotive according to claim 1, wherein the guide pin is disposed perpendicular to the axes of rotation of the drive wheel.

6. The toy locomotive according to claim 1, wherein the bogie is pivotally mounted to the locomotive body in order to enhance steering of the toy.

7. The toy locomotive according to claim 1, wherein the crown gear is an integral part of the drive wheel.

* * * * *

UNITED STATES PATENT AND TRADEMARK OFFICE

CERTIFICATE OF CORRECTION

PATENT NO. : 4,455,783

DATED : June 26, 1984

INVENTOR(S) : Toshiaki Nagano

It is certified that error appears in the above—identified patent and that said Letters Patent is hereby corrected as shown below:

Column 4, line 51, change "contract" to --contact--.

Column 5, line 43, change "it" to --its--.

Signed and Sealed this

*Eleventh* Day of *December 1984*

[SEAL]

*Attest:*

GERALD J. MOSSINGHOFF

*Attesting Officer*

*Commissioner of Patents and Trademarks*